US009968897B2

(12) United States Patent
Tölle

(10) Patent No.: US 9,968,897 B2
(45) Date of Patent: May 15, 2018

(54) MIXING MACHINE

(71) Applicant: Dr. Herfeld GmbH & Co. KG, Neuenrade (DE)

(72) Inventor: Ulrich Tölle, Detmold (DE)

(73) Assignee: DR. HERFELD GMBH & CO. KG, Neuenrade (DE)

( * ) Notice: Subject to any disclaimer, the term of this patent is extended or adjusted under 35 U.S.C. 154(b) by 379 days.

(21) Appl. No.: 14/687,718

(22) Filed: Apr. 15, 2015

(65) Prior Publication Data

US 2015/0290607 A1 Oct. 15, 2015

(30) Foreign Application Priority Data

Apr. 15, 2014 (DE) ..... 20 2014 101 787 U

(51) Int. Cl.
*B01F 7/00* (2006.01)
*B01F 13/00* (2006.01)
(Continued)

(52) U.S. Cl.
CPC ..... *B01F 13/1072* (2013.01); *B01F 3/18* (2013.01); *B01F 7/00133* (2013.01);
(Continued)

(58) Field of Classification Search
CPC ..... B01F 13/1072; B01F 7/0013; B01F 7/00158; B01F 3/18; B01F 7/00133;
(Continued)

(56) References Cited

U.S. PATENT DOCUMENTS 277,250 A 5/1883 Espel
499,890 A 6/1893 Savage
(Continued)

FOREIGN PATENT DOCUMENTS

DE 1262235 B 3/1968
EP 0225495 A2 6/1987
(Continued)

OTHER PUBLICATIONS

European Search Report in related application EP 15163351.8 dated Sep. 25, 2015.

*Primary Examiner* — Anshu Bhatia
(74) *Attorney, Agent, or Firm* — Polson Intellectual Property Law, PC; Margaret Polson

(57) ABSTRACT

This mixing machine comprises a mixing head that attaches to a container, forming a closed mixing receptacle. The head is pivotably supported in a frame such that the closed mixing receptacle can pivot to perform the mixing. The mixing head also has a rotationally driven tool which cleans the bottom of the head, supplying a low-energy transport stream for material to at least one second tool carried by the head. The second tool performs the mixing and is located inside the movement path of the bottom-cleaning first tool. The first tool has a scoop positioned in the direction of rotation of the tool with its edge facing in the direction of rotation and outward in the radial direction. The first tool comprises a first scoop section, a second, wall-cleaning scoop section and a recess open toward its closure more remote from the wall through which the second tool passes during rotation of the first tool.

12 Claims, 5 Drawing Sheets

(51) Int. Cl.

| | |
|---|---|
| ***B01F 13/10*** | (2006.01) |
| ***B01F 7/18*** | (2006.01) |
| ***B01F 15/00*** | (2006.01) |
| ***B01F 3/18*** | (2006.01) |

(52) U.S. Cl.
CPC ..... *B01F 7/00158* (2013.01); *B01F 7/00641* (2013.01); *B01F 7/18* (2013.01); *B01F 13/0098* (2013.01); *B01F 13/1002* (2013.01); *B01F 13/105* (2013.01); *B01F 15/00733* (2013.01); *B01F 2013/1086* (2013.01); *B01F 2215/005* (2013.01); *B01F 2215/0049* (2013.01)

(58) Field of Classification Search
CPC .... B01F 7/00641; B01F 7/18; B01F 13/0098; B01F 13/1002; B01F 13/105; B01F 15/00733; B01F 2013/1086; B01F 2215/0049; B01F 2215/005
See application file for complete search history.

(56) References Cited

U.S. PATENT DOCUMENTS

| | | | | |
|---|---|---|---|---|
| 1,489,538 | A | | 4/1924 | Menk |
| 1,986,530 | A | | 1/1935 | Read |
| 2,398,985 | A | | 4/1946 | Welch |
| 2,959,869 | A | | 11/1960 | Ackerman |
| 3,191,874 | A | | 6/1965 | Drinkwater |
| 3,318,537 | A | | 5/1967 | Ake |
| 3,407,511 | A | | 10/1968 | Camm |
| 3,544,280 | A | * | 12/1970 | Thomas ..... B01F 13/1013 422/134 |
| 3,853,458 | A | | 12/1974 | Wurr |
| 3,869,247 | A | | 3/1975 | Deussner |
| 3,897,934 | A | | 8/1975 | Phillips |
| 3,910,756 | A | | 10/1975 | Henning |
| 4,100,613 | A | | 7/1978 | Shaeffer |
| RE30,649 | E | | 6/1981 | Thompson |
| 4,289,279 | A | | 9/1981 | Brandt |
| 4,432,650 | A | | 2/1984 | Langen et al. |
| 4,889,432 | A | | 12/1989 | Patterson |
| 5,427,947 | A | | 6/1995 | Dalos |
| 8,678,639 | B2 | | 3/2014 | Tolle et al. |
| 8,679,639 | B2 | | 3/2014 | Tolle et al. |
| 8,979,354 | B2 | | 3/2015 | Tolle et al. |
| 2009/0040868 | A1 | | 2/2009 | Tamminga |
| 2010/0065149 | A1 | | 3/2010 | O'Callaghan |
| 2010/0226200 | A1 | * | 9/2010 | Tolle ..... B01F 3/18 366/281 |
| 2013/0186834 | A1 | | 7/2013 | Vicalvi et al. |
| 2015/0078119 | A1 | | 3/2015 | Ruberg et al. |

FOREIGN PATENT DOCUMENTS

| | | | |
|---|---|---|---|
| EP | 2460581 | A1 | 6/2012 |
| GB | 1102975 | | 2/1968 |
| WO | 2011134600 | A1 | 11/2011 |

* cited by examiner

MIXING MACHINE

CROSS REFERENCE APPLICATIONS

This application claims the benefit of German Application No Application No. 20 2014 101 787.9 filed. Apr. 15, 2014, which is incorporated herein by reference for all purposes.

BACKGROUND

The disclosure relates to a mixing machine comprising a mixing head with one or more elements for connecting it to a container containing a material to be mixed for forming a closed mixing receptacle containing the material to be mixed. The mixing head is pivotally supported in a frame in such that the mixing receptacle formed by the mixing head and the container can be rotated to carry out the mixing process The mixing head comprises a first rotationally driven tool carried by the mixing head and clearing the bottom of the mixing head for generating a low-energy transport stream for supplying mixed material contained in the mixing receptacle to at least a second tool that is carried by the mixing head and comprises only a fraction of the mixed material contained in the mixing receptacle. The mixing head also includes a transport device for mixing material in a transverse direction to that of the mixing material produced by the first tool, which at least one second tool is responsible for the actual mixing work and is located inside the movement path of the bottom-clearing first tool.

One type of such mixing machines is industrial mixers that are used to mix bulk material. For example, powdery bulk material for preparing mixtures of plastic granular material or in the dye industry. These mixing machines comprise a mixing head pivotably supported in a frame. Such heads serve to both close a container with the mixing material and to connect the mixing head for the purpose of the mixing. A closed mixing receptacle is formed by the container being connected to the mixing head. The mixing head comprises one or more connection elements, such as a peripheral flange, to connect the container to the mixing head. Due to the fact that in these mixing machines the container containing the mixing material is connected to the mixing head, these mixers are also called container mixers. The mixing head itself is pivotably arranged in a frame of the mixing machine so that the mixing can take place in an inverted position relative to the mixing head in which the mixing head is arranged at the bottom and the container connected to it is at the top.

Such previously known container mixers comprise a device for generating a flow of mixing material. In traditional mixers a tool that is axially supported in the mixing head and driven in a rotary manner by a motor serves as a device for generating a flow of mixing material. Such a tool comprises several blades projecting in a radial direction from the drive shaft so that this tool is constructed in the manner of a propeller. Such a container mixer is known from EP 0 225 495 A2. Furthermore, it can be provided that several such tools are arranged on the drive shaft. In the previously known mixers this tool serves as a mixing tool and generates a mixed thrombus in an operation of the mixture with the mixing material contained in the mixing receptacle. The mixing material is centrifuged upward by the mixing tool or tools in an axial range, deflected outward in a radial direction and then conducted back conditioned by gravity on the inner wall of the receptacle to the tools. A flow of mixing material is produced by the previously described mixing tools in which the entire mixing material present in the mixing container is contained. The mixing process takes place due to acceleration of the mixing material on the mixing tool or tools and the turbulences contained in the flow of mixing material.

The attempt is made in industrial mixing machines to achieve the desired thorough mixing in the shortest possible time. Even if a thorough mixing is basically possible in a shorter time with higher tool speeds than with tools that rotate slower, as a rule it should be taken into account that not too much heat should be charged into the material to be mixed. Care should be taken especially in a mixing of plastic granular materials since otherwise the individual particles of granular material cake with each other and/or can also cake on the tools. For this reason the mixing time is limited in the previously described mixing machines in order to prevent that the mixing material becomes too hot by the drive of the mixing tool or tools and by the jacket rubbing of the particles on the inner wall.

A container mixing machine that does not have the disadvantages indicated for the previously described mixing machines is known from EP 2 460 581 A1. This previously known mixing machine operates according to another concept. A slowly rotating, bottom-cleaning first tool serves to supply mixing material to a second tool carried by the mixing head. Very little energy is introduced into the mixing material by the first tool. The second tool is responsible for the actual mixing process. The flow of mixing material generated by the second tool runs in a transverse direction to the flow of transported mixing material made available by the first mixing tool. Since in this mixing machine the actual mixing process is carried out only by the second mixing tool and only a fraction of the mixing material located in the mixing receptacle is impacted by the second mixing tool, this mixing tool can operate with a rapid rotation in order to generate a higher energy flow of secondary mixing material which is the actual flow of mixing material produced for the mixing of the mixing material. Since only a fraction of the mixing material is impacted by the second tool and introduced into the flow of secondary mixing material and the mixing material introduced in it remains in it only for a short time, only a little heat is introduced into the mixing material. Finally, the mixing material particles conducted out of the secondary mixing material flow can cool down before they are resupplied by the first tool to the second tool for further mixing.

The bottom-cleaning transport tool in this previously known mixing machine is constructed like a helical segment whose movement path runs in the radial direction on the outside past the second tool. The helical segment is designed in such a manner that the mixing material cleaned off from the bottom is transported away from the bottom on it. This previously known mixing machine comprises two helical segments that are diametrically opposite one another as regards the axis of rotation.

Even if a considerable reduction of the charging of energy and therefore of heat is achieved during the mixing process with this previously known mixing machine, it would nevertheless be desirable if the charging with heat could be reduced even further.

The foregoing example of the related art and limitations related therewith are intended to be illustrative and not exclusive. Other limitations of the related art will become apparent to those of skill in the art upon a reading of the specification and a study of the drawings.

SUMMARY

The following embodiments and aspects thereof are described and illustrated in conjunction with systems, tool and methods which are meant to be exemplary and illustrative, not limiting in scope. In various embodiments, one or more of the above described problems have been reduced or eliminated, while other embodiments are directed to other improvements.

The present disclosure solves this problem with an initially cited generic mixing machine in which the at least one first tool is built like a scoop and is placed in the direction of rotation of the tool with its edge facing in the direction of rotation radially outward and in which the first tool comprises a first scoop section closer to the bottom, a following second wall-cleaning scoop section and a recess open to its closure further from the wall through which recess the second tool is conducted during the rotation of the first tool.

When the concepts "bottom-cleaning" and "wall-cleaning" are used in the frame of these comments, they denote the movement of mixing material away from the bottom or away from the wall. This does not necessarily mean that the tool must make contact with the mixing head on the bottom or on the wall.

In contrast to the mixing machine known from EP 2 460 581 A1, in this mixing machine the at least one first tool is designed in the manner of a scoop that is placed opposite the direction of rotation of the tool with its closure facing in the direction of movement toward the wall of the mixing head and therefore in the direction of the axis of rotation. The scoop itself is subdivided into a first scoop section closer to the bottom and a following scoop section that cleans the wall. In addition, the scoop has a tool recess through which the second tool is conducted upon a rotary movement of the first tool. This tool recess is open to its closure that is further from the wall because of the positioning of the scoop. The scoop section closer to the bottom is preferably positioned for carrying out the bottom-cleaning function opposite the plane of the second scoop section. Based on the wall-cleaning function of the second scoop section, mixing material is transported upon a rotary movement of this tool from the wall of the mixing head in the direction of the hub or shaft of the first tool. If the first tool passes the second tool, mixing material is transported in the same direction to the second tool. This transporting of mixing material away from the wall of the mixing receptacle and in the direction of the hub brings it about that in the mixing position of the mixing receptacle mixing material falls down from the wall of the mixing head in the direction of the bottom of the mixing head and therefore to the second tool due to the wall-cleaning removing motion. To this end the scoop-like design of the first transporting tool is preferably constructed like a paddle or a ruder, wherein the mixing material that is falling down falls down on the lee side.

Investigations have shown that in this concept the rotational speed of the first tool can be reduced up to 50% and more compared to the necessary rotational speed of the mixer known from EP 2 460 581 A1 without the mixing time of a batch having to be extended to achieve the same mixing result. The lower rotational speed of the first tool not only reduces the heat charge but also the energy consumption of the mixing machine. It is also especially advantageous in this mixing machine concept that the scoop section closer to the bottom, and preferably designed to be bottom-cleaning, and the wall-cleaning scoop section can be equipped with flexible strip lips that contact the bottom and the inner wall of the mixing head so that wall caking and/or bottom caking cannot occur or is at the most only very minor A cleaning of the inner space of the mixing head after a batch change is correspondingly simpler and more rapid if a different material is to be mixed in a following batch.

The angle of attack of the first tool relative to a radius is preferably between approximately 50° and approximately 70°. Especially good results are achieved with an angle of attack of approximately 60°.

In order to generate a uniform wall-cleaning movement of the mixing material above the level of the wall-cleaning scoop section, its front edge closer to the wall is constructed to be greater than the height of the wall or of the wall section with the same interval to the latter. This wall-cleaning scoop section is designed to be longer relative to its extent facing in the direction of movement than the preferably bottom-cleaning scoop section adjacent to it toward the bottom of the mixing receptacle. The wall-cleaning scoop section can be constructed like a plate. It is also possible to construct this section with a curvature in the direction of the axis of rotation or also to provide a first area like a plate bordering on the wall-cleaning edge and to provide an area following it that is curved in the cited manner or that is angled projecting inward opposite this plane.

In a preferred further embodiment of a mixing machine conceived in such a manner, a bottom-cleaning countertool is connected to the shaft of the first tool. This countertool is positioned opposite a radius at such an angle that the mixing material seized by this tool is moved away from the hub and the shaft. The first tool and the countertool are coordinated with one another so that the mixing material seized by them is moved toward the second tool. Therefore, these tools are designed so that they can be moved with the closest possible distance past the second tool during their rotary movement.

According to another preferred embodiment it is provided that two first tools are diametrically opposite one another and two countertools are diametrically opposite one another. Each first tool is in a radial arrangement with a countertool. They then form an obligatory supply conduit for an especially effective supply of mixing material to the mixing tool—the second tool—responsible for the actual mixing process.

This can be a differently designed tool depending on the desired mixing and/or the material to be mixed. A tool is typically used as the second mixing tool that is equipped with mixing blades and is driven at very high or high rotational speeds. In any case, the speed of this tool exceeds the rotational speed of the first tool. A mixing machine with such a mixing head can also be provided with several second mixing tools that can also have different designs. If a dispersing of the mixing material is desired, a tool equipped with blade tools is used as the second tool—the actual mixing tool. If a homogenization of the mixing material is provided, a second mixing tool designed in the manner of a screw conveyor can also be used. When one of these mixing tools is used in a single mixing head the mixing result as regards the magnitudes "dispersing" and "homogenization" can then be adjusted by an appropriate individual controlling of these tools.

In addition to the exemplary aspects and embodiments described above, further aspects and embodiments will become apparent by reference to the accompanying drawings forming a part of this specification wherein like reference characters designate corresponding parts in the several views.

BRIEF DESCRIPTION OF THE DRAWINGS

The invention is described in the following using an exemplary embodiment with reference made to the attached figures. In the drawings.

Before explaining the disclosed embodiment of the present invention in detail, it is to be understood that the invention is not limited in its application to the details of the particular arrangement shown, since the invention is capable of other embodiments. Exemplary embodiments are illustrated in referenced figures of the drawings. It is intended that the embodiments and figures disclosed herein are to be considered illustrative rather than limiting. Also, the terminology used herein is for the purpose of description and not of limitation.

DETAILED DESCRIPTION

Figure 1:
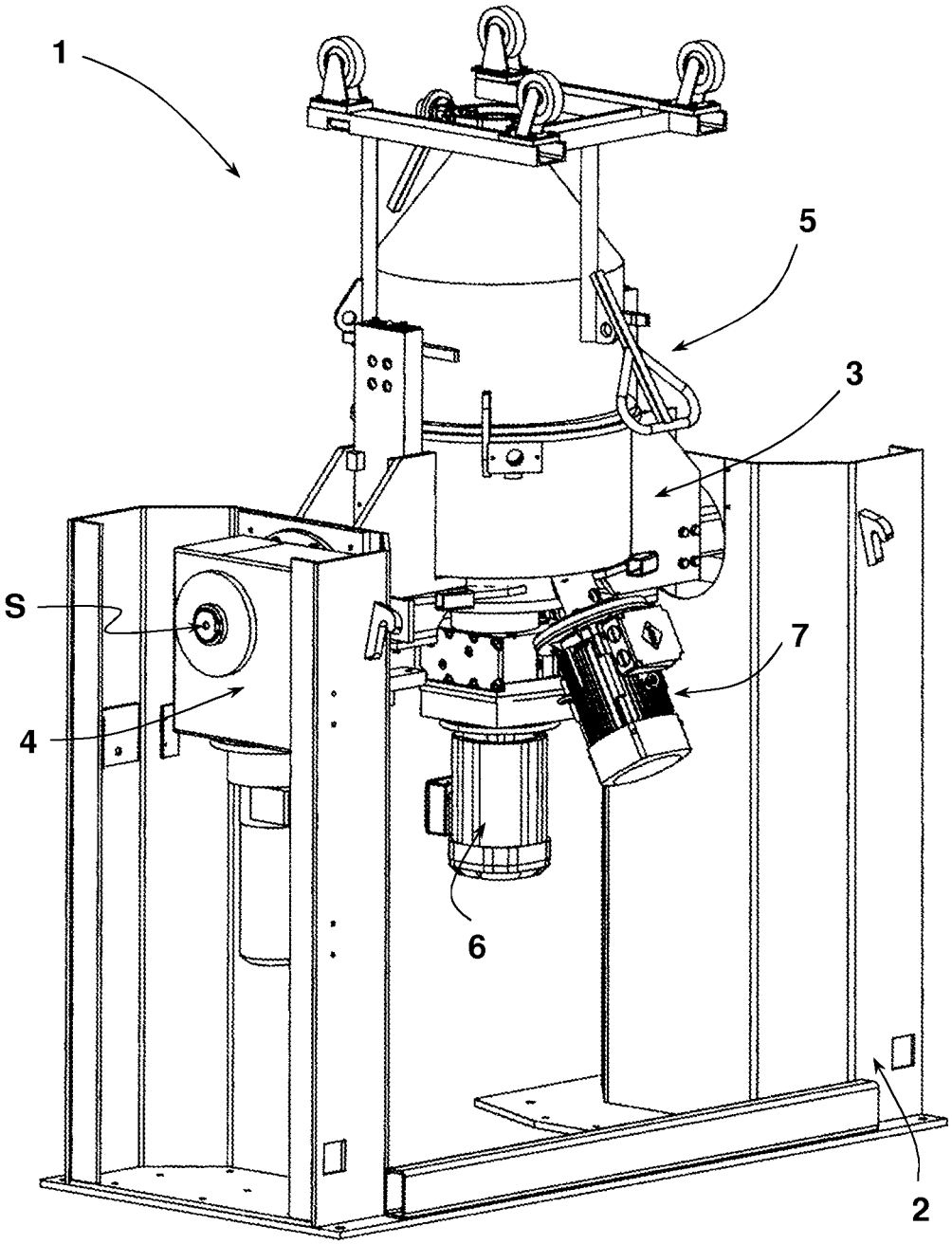
FIG. 1 is a schematic perspective view of a mixing machine with a container containing a mixing material, connected to the mixing head of the mixing machine and in a mixing position.

A mixing machine 1 for industrial purposes comprises a frame 2 on which a mixing head 3 is pivotably supported. The pivot axis of the mixing head 3 is made recognizable with the reference sign S in FIG. 1. The mixing head 3 can pivot about its pivot axis S at least through 180° by a drive 4. In the exemplary embodiment the pivotability of the mixing head 3 serves the purpose that in its rotated position through 180° opposite the view in FIG. 1 a container 5 containing a mixing material is brought up as a container containing mixing material to the mixing head 3 and can be connected to it in order to be able to pivot the unit—the actual mixing container—formed by container 5 for mixing material and of mixing head 3 into the mixing position of the mixing head 3 shown in FIG. 1. In this position the mixing head 3 of the mixing machine 1 is at the bottom in order that the mixing material contained in the mixing material container 5 falls onto the tools arranged in the mixing head 3.

The mixing head 3 of the exemplary embodiment shown comprises two tools that are driven by an electromotor. A first electromotor 6 serves to drive a first tool unit; a second electromotor 7 serves to drive a second tool.

Figure 2:
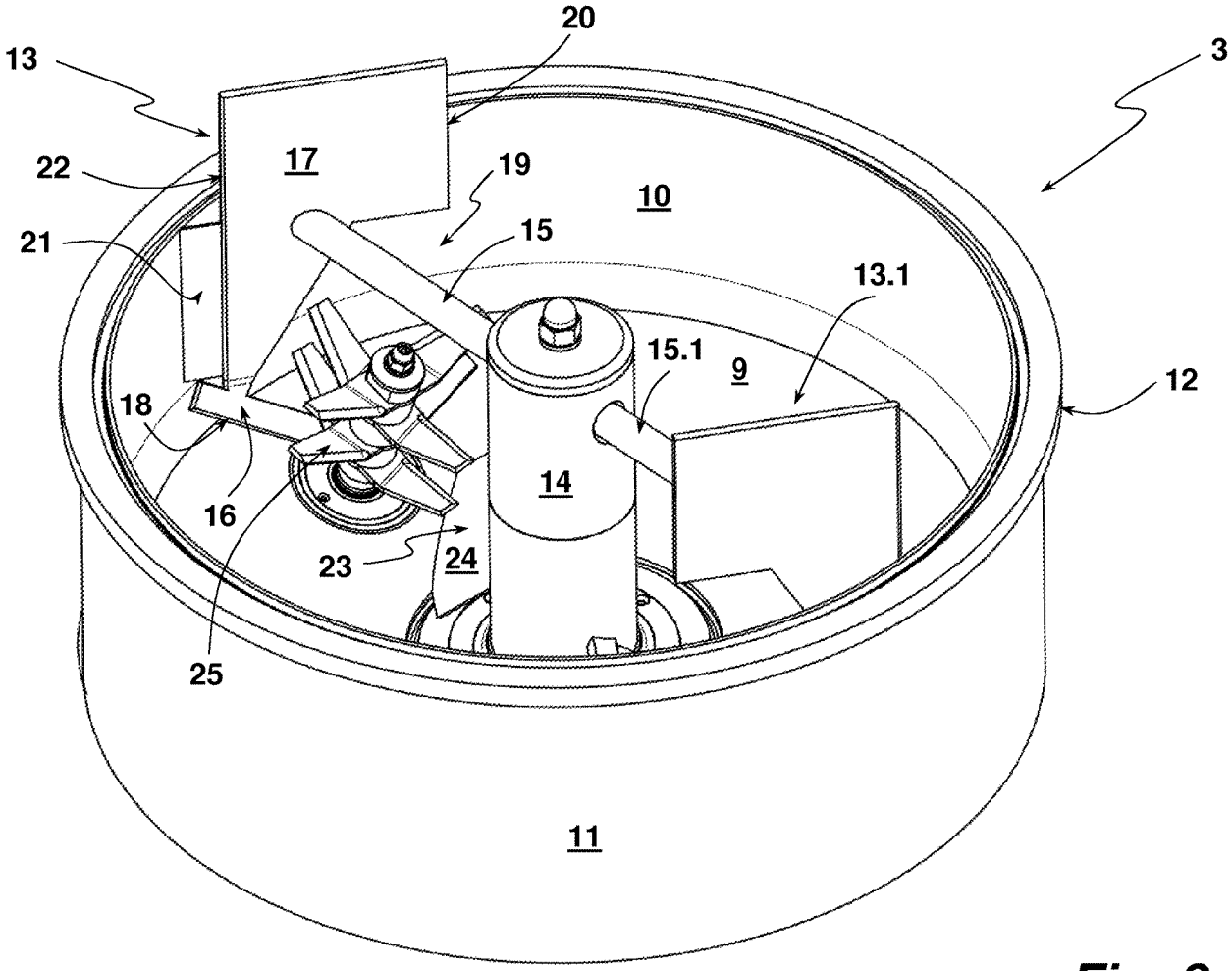
FIG. 2 is a perspective view into the mixing head of the mixing machine of FIG. 1 from a first direction of view.

FIG. 2 shows the mixing head 3 in a perspective view without the mixing material container 5 connected to it. The mixing head 3 comprises a receptacle part 8 with a bottom 9 and a cylindrical wall section 10 formed on it. The transition from the bottom 9 and into the wall section 10 is carried out by forming a radius. The receptacle part 8 is enclosed in a housing 11. The housing 11 carries a coupling flange 12 on its free end on which flange a coupling piece 3 of the mixing material container 5 with a complementary design rests after the connection to the mixing head 3. Therefore, in the exemplary embodiment shown the coupling flange 12 serves as an element for connecting a container containing mixing material, here: the mixing material container 5 to the mixing head 3.

Two tools 13, 13.1 are driven in a rotary manner by the electromotor 6 as the first tool unit. These tools are also called first tools 13, 13.1 in the framework of these explanations. The shaft 14 of the electromotor 6 extends through the bottom 9 of the receptacle part 8 in its middle and also extends through the bottom of the housing 11. The axis of rotation of shaft 14 is therefore aligned with the longitudinal axis of the mixing head 3. The tools 13 and 13.1 are connected to the shaft 14 by an arm 15. 15.1. When the tool 13 is described in the following, the explanations also apply, unless otherwise indicated, to the tool 13.1.

The tool 13 is designed as regards its functionality like a scoop and is placed opposite the direction of rotation indicated by the block arrows. The position of the tool 13 located on the arm 15 is directed, starting from an arrangement of the tool 13, with which the latter forms an angle of 90° with the radius R formed by the transport arm 15, outward toward the wall section 10 with its front edge facing in the direction of rotation. As a consequence of this position, this tool 13 is wall-cleaning. Therefore, upon a rotary movement of the tool 13 this mixing material is transported from the wall section 10 in the direction of the shaft 14. The scoop-like tool 13 is subdivided into a first scoop section 16 close to the bottom and into a following second scoop section 17. In addition to the previously described radial position of the tool 13, the first scoop section 16 is additionally positioned opposite to the plane of the second scoop section 17 and in the exemplary embodiment shown at approximately 25° with its edge 18 of the scoop section 16 facing the bottom in the direction of rotation. As a result of this construction of the first scoop section 16, it is bottom-cleaning in order to transport mixing material away in the direction of the bottom 9 of the mixing head 3. In the exemplary embodiment shown the angle of the position of the scoop section 16 opposite the radius, compared with the position angle of the second scoop section 17, is slightly greater, by approximately 15°. The bottom-cleaning scoop section 16 borders on a recess 19. The recess 19 is introduced into the tool 13 starting from its closure 20 facing opposite the direction of rotation. The first scoop section 16, that is closer to the bottom, is constructed to be distinctly lower as regards its height compared to the height of the second scoop section 17.

In the exemplary embodiment shown in the figures a stripping lip 21 is arranged on the front edge 21 of the wall-cleaning scoop section 17 that faces in the direction of rotation in its section extending substantially above the height of the wall section 10. This lip is manufactured from an elastic material and extends from the edge 22 to wall section 10 and therefore makes contact with the latter. The stripping lip 21 acts with a certain pretension against the surface of the wall section 10 and serves to strip off particles of mixing material that could be adhered to it. In the embodiment of the mixing machine according to the figures only the tool 13 carries such a stripping lip 21. It is not necessary that both tools 13, 13.1 carry a stripping lip at this position. The tool 13 is provided with such a stripping lip 21 preferably when PE material or PP material is mixed in the mixing head 3.

A countertool 23 is located inside in the radial direction with regards to the first, bottom-clearing scoop section 16 of the tool 13, also driven by the shaft 14. The countertool 23, since it is connected to the shaft 14, is driven in the same direction of rotation in a rotating manner like the tool 13. The countertool 23 is also a bottom-cleaning tool that is positioned as regards the direction of rotation in the other direction of rotation like the tool 13. In the embodiment shown a stripping lip 24 is connected to the countertool 23 which lip serves the same purpose as the previously described stripping lip 21 present on the scoop section 17. Due to the arrangement of the tool 13 and of the countertool 23, mixing material is moved on the one hand from the wall section 10 in the direction of the shaft 14 and on the other hand by the counter-tool 23 from the shaft 14 in a bottom-cleaning manner back in the direction of the wall section 10. A collection of mixing material that did not participate in the mixing process is prevented in the area of the shaft 14 by the countertool 23. Since two first tools 13, 13.1 are provided in the exemplary example shown; two countertools 23, 23.1 are also provided.

The electromotor 7 of the mixing head 3 serves to drive a second tool 25. The second tool also extends with its shaft through the bottom 9 of the receptacle part 8 and the bottom of the housing 11, which bottom cannot be recognized in FIG. 2. The shaft and therefore the axis of rotation of the tool 25 is inclined to the axis of rotation of the shaft 14 as can be readily recognized in the figures. The mixing tool 25 is a known mixing tool with several mixing blades seated superposed on the shaft. The actual mixing work is carried out during an operation of the mixing machine 1 by this tool 25 operated at a high or very high speed. The first tools 13, 13.1 and the countertools 23, 23.1 cooperating with them and serve to supply mixing material to the mixing tool 25, and to remove mixing material seized by the mixing tool 25.

Figure 3:
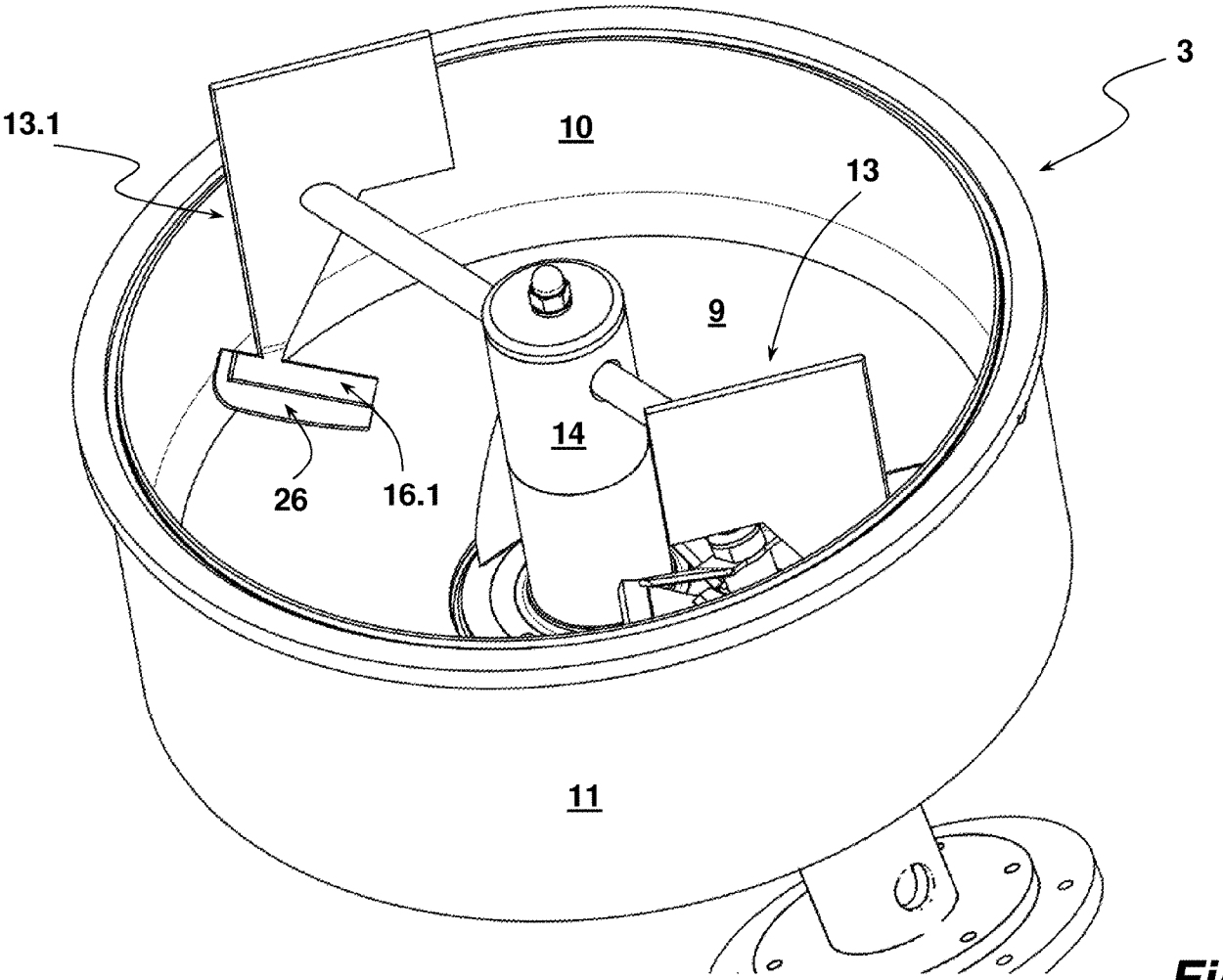
FIG. 3 is a perspective view into the mixing head of the mixing machine of FIG. 1 from another direction of view.

It can be recognized from the view into the mixing head 3 from the perspective in FIG. 3 regarding the first tool 13.1 that its first, bottom-cleaning scoop section 16.1 is also equipped with a stripping lip 26, namely, in the manner already described for this above for the stripping lip 21. The stripping lip 26 rests in the exemplary embodiment shown under pretension on the bottom 9 of the receptacle part 8 and extends over the inner radius connected in the bottom 9 to the wall section 10 into the lowest wall section 10.

The views of the mixing head 3 in the FIGS. 2 and 3 show that the first tools 13, 13.1 have a greater extent in the direction of the longitudinal axis of the mixing head 3 than the height of the wall section 10. Therefore, these tools 13, 13.1 extend into a mixing material container 5 connected to them.

Figure 4:
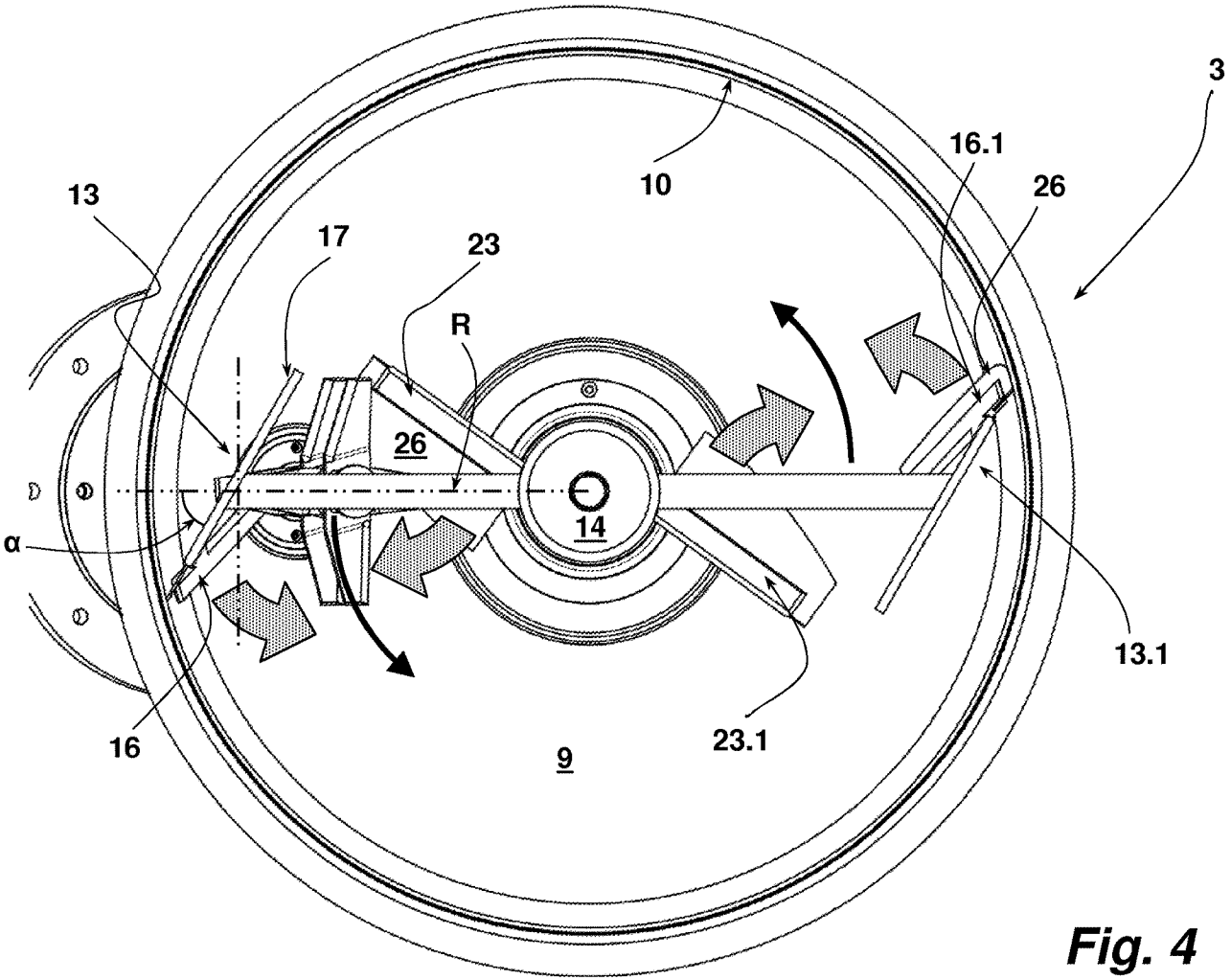
FIG. 4 is a top view onto the mixing head of FIGS. 2 and 3.

FIG. 4 shows a top view of the bottom 9 of the mixing head 3 with the radial alignment of the arms 15, 15.1 emanating from the shaft 14. In this exemplary embodiment the view shows the radii R formed by the arms 15, 15.1. The tool 13 is connected to the end of the arm 15. The positioning angle can be recognized in it by $\alpha$. The opposing position of the countertool 23 relative to the tool 13 and the movement of the mixing material running to each other upon a rotary movement of the shaft 14 with the tools 13, 23 connected to it caused by this opposing position also become clear from this view of the mixing head 3. The same naturally applies to the tools 13.1, 23.1, that lie opposite the tools 13 and 23 relative to the shaft 14. FIG. 4 schematically shows the movement of the material in the area of the tools 13, 13.1 and 23, 23.1 with block arrows and shows the direction of rotation of the tools 13, 13.1 and 23, 23.1 by arrows. This movement of material that is directed in a diverging manner conducts the mixing material to the second tool 25 provided for the actual thorough mixing in an especially effective manner.

Figure 5:
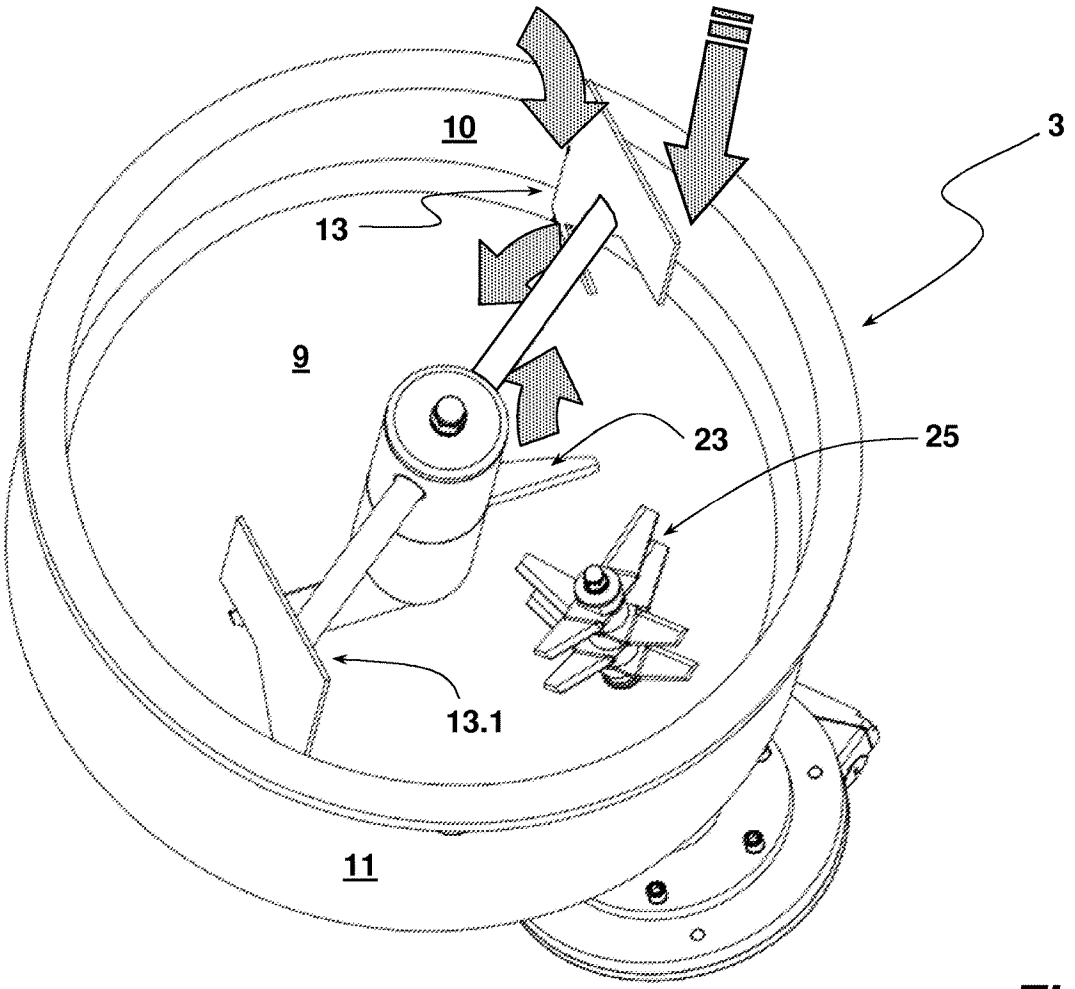
FIG. 5 is a perspective view into the mixing head with the moving of the mixing material indicated by block arrows.

FIG. 5 again shows a perspective view into the mixing head 3. In this figure the previously described movement of falling-down mixing material upon a rotary movement of this first tool 13 is schematically indicated using the tool 13.

The previously explained countertools are designed as was explained in principle for the first tools 13, 13.1 in an exemplary embodiment not shown in the figures. In this embodiment the countertools comprise, in addition to the described bottom-cleaning tool section, a second wall-cleaning tool section following the first one. A recess is present between the two tool sections, just as in the case of the tools 13, 13.1, through which recess the second tool can be conducted. The wall-cleaning tool section comprised by at least one of the countertools is also positioned opposite to the direction of the first tool. Mixing material is moved away from the shaft 14 in a radial direction by the flow-cleaning tools section of the countertool, as in the case of the first tool, and the same falling down effect of the mixing material in the direction of the bottom of the mixing head develops as was previously described using the tool 13 in regard to the outer wall section 10 of the mixing head 3. However, the mixing material was moved outward by the shaft 14 in a radial direction.

While a number of exemplary aspects and embodiments have been discussed above, those of skill in the art will recognize certain modifications, permutations, additions and sub-combinations therefore. It is therefore intended that the following appended claims hereinafter introduced are interpreted to include all such modifications, permutations, additions and sub-combinations are within their true spirit and scope. Each apparatus embodiment described herein has numerous equivalents.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims. Whenever a range is given in the specification, all intermediate ranges and subranges, as well as all individual values included in the ranges given are intended to be included in the disclosure.

In general the terms and phrases used herein have their art-recognized meaning, which can be found by reference to standard texts, journal references and contexts known to those skilled in the art. The above definitions are provided to clarify their specific use in the context of the invention.

LIST OF REFERENCE NUMERALS

1 Mixing Machine
2 Frame
3 Mixing head
4 Drive
5 Mixing material container
6 Electromotor
7 Electromotor
8 Receptacle part
9 Bottom
10 Wall section
11 Housing
12 Coupling flange
13, 13.1 First tool
14 Shaft
15, 15.1 Arm
16, 16.1 Scoop section
17 Scoop section
18 Edge
19 Recess
20 Closure
21 Stripping lip
22 Edge

23, 23.1 Countertool
24 Stripping lip
25 Second tool
26 Stripping lip
R Radius
S Pivot axis
α Positioning angle

I claim:

1. A mixing machine comprising:

a mixing head having one or more connecting elements for attaching the mixing head to a container, thereby forming a closed mixing receptacle for containing a material to be mixed;

said mixing head being pivotally supported in a frame such that the mixing receptacle can pivot to carry out the mixing process;

said mixing head comprises at least one first tool and at least one second tool, the first tool and the second tool being rotationally driven;

the first tool generating a low-energy transport stream for supplying mixing material contained in the mixing receptacle to the second tool, the low-energy transport stream comprising only a fraction of the mixing material contained in the mixing receptacle; the second tool is responsible for the actual mixing work and is located inside the movement path of the first tool;

the first tool comprises a first scoop section having an edge that clears the bottom of the mixing head, a second scoop section following the first scoop section having an edge facing in the direction of rotation of the first tool that clears the wall of the mixing head, and a recess open toward its closure more remote from the wall of the mixing head through which the second tool is conducted upon rotation of the first tool;

the first scoop section and the second scoop section each being arranged at a positioning angle relative to the radius of the mixing head running through the first tool thereby moving mixing material away from the bottom and the wall of the mixing head;

the positioning angle being between approximately 50° and approximately 70°; the first scoop section being arranged at a first positioning angle and the second scoop section being arranged at a second positioning angle.

2. The mixing machine of claim 1, wherein the positioning angle of the first tool is approximately 60°.

3. The mixing machine of claim 1, wherein the first positioning angle of the first scoop section is the same as the second positioning angle of the second scoop section.

4. The mixing machine of claim 1, wherein the first positioning angle of the first scoop section is smaller than the second positioning angle of the second scoop section.

5. The mixing machine of claim 1, wherein the second scoop section has a greater radial extent and a greater extent in the direction of rotation of the first tool than the first scoop section.

6. The mixing machine of claim 1, wherein the first scoop section is positioned at an angle to the plane of the second scoop section with the side of the first scoop section facing in the direction of rotation of the first tool facing away from the bottom of the mixing head.

7. The mixing machine of claim 6, wherein the first scoop section is angled between approximately 25° and approximately 45° to the plane of the second scoop section.

8. The mixing machine of claim 1, wherein the bottom-cleaning edge of the first scoop section further comprises a flexible stripping lip that makes contact with the bottom of the mixing head.

9. The mixing machine of claim 1, wherein the wall-cleaning edge of the second scoop section further comprises a flexible stripping lip that makes contact with the wall of the mixing head.

10. The mixing machine of claim 1, further comprising two first tools, said first tools being spaced apart with the same angular spacing.

11. The mixing machine of claim 1, further comprising a bottom-cleaning countertool driven together with the first tool, said bottom-cleaning countertool arranged on a shaft of the first tool opposing the scoop sections of the first tool and cooperates with the first tool on in moving mixing material to the second tool.

12. The mixing machine of claim 11, wherein the countertool comprises a wall-clearing tool section adjacent to a bottom-cleaning tool section and is therefore constructed in principle like the first tool with an opposing positioning angle.

* * * * *